US009890918B2

(12) United States Patent
Singer et al.

(10) Patent No.: US 9,890,918 B2
(45) Date of Patent: Feb. 13, 2018

(54) HEADLIGHT DEVICE

(71) Applicant: OSRAM GmbH, Munich (DE)

(72) Inventors: Frank Singer, Regenstauf (DE); Stefan Grötsch, Bad Abbach (DE)

(73) Assignee: OSRAM GmbH, München (DE)

( * ) Notice: Subject to any disclaimer, the term of this patent is extended or adjusted under 35 U.S.C. 154(b) by 247 days.

(21) Appl. No.: 14/654,539

(22) PCT Filed: Dec. 17, 2013

(86) PCT No.: PCT/EP2013/076957

§ 371 (c)(1),
(2) Date: Jun. 21, 2015

(87) PCT Pub. No.: WO2014/095906

PCT Pub. Date: Jun. 26, 2014

(65) Prior Publication Data

US 2015/0338044 A1 Nov. 26, 2015

(30) Foreign Application Priority Data

Dec. 21, 2012 (DE) ..... 10 2012 112 994

(51) Int. Cl.

| | |
|---|---|
| ***F21S 8/10*** | (2006.01) |
| ***F21V 7/22*** | (2018.01) |
| ***F21V 9/16*** | (2006.01) |
| *F21V 7/00* | (2006.01) |
| *F21V 7/06* | (2006.01) |

(Continued)

(52) U.S. Cl.

CPC ..... *F21S 48/1225* (2013.01); *F21S 48/1145* (2013.01); *F21S 48/13* (2013.01);
(Continued)

(58) Field of Classification Search
None
See application file for complete search history.

(56) References Cited

U.S. PATENT DOCUMENTS

2007/0046176 A1* 3/2007 Bukesov ..... C09K 11/08 313/496
2010/0328617 A1 12/2010 Masuda
(Continued)

FOREIGN PATENT DOCUMENTS

DE 102007055480 B3 8/2009
DE 102011003665 A1 8/2012
(Continued)

OTHER PUBLICATIONS

Suckling, J., et al., "Laser Headlight for Next Generation Automotive Lighting," 9th international symposium on automotive lighting, Darmstadt, 2011, pp. 271-280.

*Primary Examiner* — Britt D Hanley
(74) *Attorney, Agent, or Firm* — Slater Matsil, LLP

(57) ABSTRACT

A headlight device is disclosed. In an embodiment a headlight device includes a laser light source configured to emit collimated primary radiation, a conversion element comprising conversion regions configured to at least partly convert the collimated primary radiation into secondary radiation and to form luminous regions during operation, and separating webs which separate the conversion regions from one another, wherein the separating webs are nontransmissive to the collimated primary radiation and secondary radiation and a deflection unit configured to direct the collimated primary radiation onto the conversion element and to guide the collimated primary radiation as a scanning beam over partial regions of the conversion element.

19 Claims, 2 Drawing Sheets

(51) Int. Cl.
*F21Y 115/30* (2016.01)
*F21Y 115/10* (2016.01)

(52) U.S. Cl.
CPC ..... *F21S 48/1388* (2013.01); *F21S 48/145* (2013.01); *F21S 48/15* (2013.01); *F21V 7/22* (2013.01); *F21V 9/16* (2013.01); *F21S 48/1323* (2013.01); *F21S 48/328* (2013.01); *F21V 7/0033* (2013.01); *F21V 7/06* (2013.01); *F21Y 2115/10* (2016.08); *F21Y 2115/30* (2016.08)

(56) References Cited

U.S. PATENT DOCUMENTS

2011/0157865 A1* 6/2011 Takahashi ..... F21S 48/115 362/84
2011/0199580 A1* 8/2011 Hirata ..... G03B 21/20 353/31
2011/0249460 A1* 10/2011 Kushimoto ..... B60Q 1/085 362/510
2011/0280033 A1* 11/2011 Kishimoto ..... F21S 48/1145 362/543
2012/0051074 A1* 3/2012 Takahashi ..... F21S 48/1145 362/509
2012/0106183 A1 5/2012 Takahashi
2013/0258689 A1* 10/2013 Takahira ..... F21S 48/17 362/465
2013/0314896 A1 11/2013 Finsterbusch

FOREIGN PATENT DOCUMENTS

EP 2360523 8/2011
EP 2492579 A2 8/2012
WO 2009143802 A1 12/2009

* cited by examiner

HEADLIGHT DEVICE

This patent application is a national phase filing under section 371 of PCT/EP2013/076957, filed Dec. 17, 2013, which claims the priority of German patent application 10 2012 112 994.0, filed Dec. 21, 2012, each of which is incorporated herein by reference in its entirety.

TECHNICAL FIELD

A headlight device is specified.

BACKGROUND

For headlight applications, light sources are desired which during operation generate luminous regions distinguished by a sharp shutter edge having high contrast. In the region of the shutter edge, a high bright-dark contrast is then present between the luminous region and adjoining regions. In the case of a light source composed of a plurality of LED chips, the problem occurs that for a sufficient luminance the LED chips ought to be arranged at the smallest possible distance from one another. However, this entails the disadvantage that high contrast cannot be obtained on account of optical crosstalk.

SUMMARY OF THE INVENTION

Embodiments of the invention provide a headlight device which generates luminous regions having a sharp shutter edge during operation.

In accordance with at least one embodiment, the headlight device comprises a laser light source for emitting collimated primary radiation. By way of example, the laser light source can comprise at least one laser diode chip which emits coherent radiation. The laser diode chip can be formed with a semiconductor material, for example.

Furthermore, the headlight device comprises a conversion element having conversion regions which are provided for at least partly converting the collimated primary radiation into secondary radiation and form luminous regions during operation. The primary radiation has, in particular, a shorter wavelength than the secondary radiation.

Furthermore, the conversion element has separating webs which separate the conversion regions from one another and are nontransmissive to the primary radiation and secondary radiation. Advantageously, optical crosstalk, so-called crosstalking, between the conversion regions can be prevented or at least reduced by the nontransmissive separating webs. Here and hereinafter, "crosstalking" and "optical crosstalk" are understood to mean the effect that the primary radiation and/or secondary radiation coming from a conversion region can pass into an adjacent conversion region and excite the latter to undesired emission of electromagnetic radiation.

Preferably, the conversion element is arranged at a distance from the laser light source. Therefore, the conversion element is in particular not arranged directly on the laser light source.

In accordance with at least one embodiment, the conversion element is arranged on a carrier. Preferably, the carrier is embodied as a heat sink. In particular, the conversion element is in direct contact with the carrier embodied as a heat sink. This enables good cooling of the conversion element during operation, such that no or only a minor impairment of the conversion efficiency occurs. By way of example, the heat sink can be formed from Cu, Al or a light metal diecast part containing Zn, Mg or Al.

The headlight device additionally comprises a deflection unit, which is provided for directing the collimated primary radiation coming from the laser light source during operation onto the conversion element and guiding it as a scanning beam over partial regions of the conversion element. In other words, in a manner similar to that in the case of a scanning method of a scanner, the primary radiation emitted by the laser light source is guided over partial regions of the conversion element by means of the deflection unit. Consequently, only the conversion regions over which the scanning beam is guided are excited for emission of radiation. In this case, the beam guiding is carried out fast enough such that the human eye cannot follow it. Luminous regions which can be projected onto the roadway to be illuminated by means of a projection optical unit are generated in this way.

The collimated primary radiation coming from the laser light source can be guided over the entire surface of the conversion element by means of the deflection unit. In order to generate specific luminous regions which produce a desired light distribution or a specific luminous pattern, the laser light source can be switched on or off when specific partial regions are reached. In this way, the headlight device can emit pixelated light, also called "pixel light", wherein each pixel is formed by a luminous region. The pixel light can also be referred to as a matrix beam. By way of example, the individual pixels are arranged to form rows and columns.

The headlight device is suitable in particular as an AFS (adaptive front lighting system) headlight device in a vehicle. The pixel light can advantageously be used for the targeted illumination of traffic signs or sources of danger or as cornering light. Furthermore, the oncoming traffic can be masked out by means of the pixel light.

In accordance with at least one embodiment of the headlight device, a luminous region attains a luminance of 50 to 500 $Mcd/m^2$.

In accordance with at least one embodiment, a partial region consists of a single conversion region. The scanning beam therefore "scans" a partial region consisting of a single conversion region. During operation, the scanning beam is then successively moved over the conversion regions and switched off if a specific conversion region is not intended to be caused to become luminous.

In accordance with at least one embodiment, the conversion element comprises a main body and a conversion material. Depressions are introduced into the main body and interrupt a main surface of the main body. Furthermore, the main body has separating webs which separate the depressions from one another. The conversion material is arranged in the depressions. The conversion regions are formed by the depressions provided with the conversion material and are separated from one another by the separating webs of the main body.

The conversion material can be introduced into the depressions, for example, by means of sedimentation, electrophoresis, blade coating or jetting.

The conversion material preferably contains phosphors that can be embedded into a matrix material. The matrix material can provide for a good adhesion between the main body and the phosphors after application.

By way of example, at least one of the following materials is appropriate for the phosphors:

Garnets doped with rare earth metals, alkaline earth metal sulfides doped with rare earth metals, thiogallates doped with rare earth metals, aluminates doped with rare earth metals, orthosilicates doped with rare earth metals, chlorosilicates doped with rare earth metals, alkaline earth metal silicon nitrides doped with rare earth metals, oxynitrides doped with rare earth metals, aluminum oxynitrides doped with rare earth metals.

Preferably, the phosphors are formed from doped garnets such as Ce-or Tb-activated garnets such as YAG:Ce, TAG:Ce, TbYAG:Ce.

In accordance with at least one embodiment, the primary radiation is unconverted and has a wavelength of between 440 nm and 460 nm, which is particularly suitable for the excitation of YAG phosphors. Alternatively, the primary radiation may already be converted, wherein a converter that re-emits in the visible blue range is excited by radiation having a wavelength of 405 nm.

In accordance with at least one embodiment, mixed-colored radiation composed of the primary radiation and the secondary radiation is emitted from the conversion regions during operation. By way of example, the blue light emitted by the laser light source can be at least partly converted into green and/or red and/or yellow light by the conversion element, such that the headlight device emits white light during operation.

The depressions of the conversion element can have the shape of an inverted cone or truncated cone, an inverted pyramid or an inverted truncated pyramid. It is also possible for the depressions to be embodied in parallelepipedal fashion. The conversion regions that arise as a result of the depressions being filled with the conversion material can have corresponding shapes.

In accordance with at least one embodiment, the depressions are arranged in a matrix-like fashion in the main body. In other words, the main body has depressions which occur at regular spacings and which are arranged along rows and columns.

In accordance with at least one embodiment, at least one sidewall of the depressions is embodied in reflective fashion. This advantageously reduces absorption losses caused by the separating webs. Furthermore, the separating webs at the main surface can be embodied in absorbent fashion, for example, by virtue of a roughening of the main body or by virtue of an absorbent coating, whereby it is possible to suppress optical crosstalk at the main surface.

The "at least one sidewall" of the depression should be understood to mean, in particular, that the depression has only one reflective sidewall if it is embodied in circularly symmetrical fashion. If the depression is embodied in rotationally symmetrical fashion, it has in particular four reflective side surfaces.

In accordance with at least one embodiment, the reflective sidewall is formed by a reflection layer arranged on the main body. The reflection layer can be a reflective coating formed from a metal or a metal compound. However, it is also conceivable for the reflection layer to be embodied in diffusely reflective fashion. By way of example, the reflection layer can contain a reflective material such as TiO2.

In accordance with at least one embodiment, at least one sidewall runs obliquely with respect to the main surface of the main body. In the case of a rotationally symmetrical form of the depressions, the latter have preferably at least two, particularly preferably four, obliquely running sidewalls. The sidewall can run in particular perpendicularly or at an angle of less than 90° with respect to the main surface of the main body. Particularly preferably, the depressions taper proceeding from the main surface. In other words, a cross-sectional area of the depressions thus becomes smaller and smaller proceeding from the main surface. In this case, the depressions advantageously have a beam shaping effect.

In accordance with at least one embodiment, the main body contains a semiconductor material or a metal. In the case of a metal, the reflection layer can advantageously be dispensed with if a reflective metal such as aluminum, for example, is used for forming the main body. Suitable semiconductor materials are Si, Ge or GaAs, for example. Si, in particular, is distinguished by a good thermal conductivity.

In accordance with at least one embodiment, the depressions are etched into the main body. The depressions are advantageously etched along crystal planes. By way of example, the depressions can be etched in Si along the {111} planes, wherein the sidewalls of the etched depressions form an angle of 54.7° with the main surface of the main body.

The cross-sectional areas of the depressions arranged at the main surface advantageously have a side length of between 200 μm and 1000 μm. The depth is preferably between 20 μm and 500 μm. The separating webs arranged between the depressions can have a width of between 0 μm and 200 μm.

In accordance with at least one embodiment, the conversion material does not project beyond the main surface of the main body. In this way, optical crosstalk between adjacent conversion regions can advantageously be prevented or at least reduced. In particular, the conversion element terminates flush with the main surface of the main body or has a concave surface. By way of example, the main body can be resurfaced by grinding or overetched after the introduction of the conversion element, thus giving rise to a planar surface.

In accordance with at least one embodiment, the conversion element has an optical device, which is arranged on the main body and covers the conversion regions. By way of example, the optical device can comprise one or a plurality of antireflection layers. Additionally or alternatively, the optical device can comprise a lens array, wherein in particular each conversion region is assigned a lens. The at least one antireflection layer can advantageously reduce radiation losses that occur during the coupling-out of radiation from the conversion element. Moreover, the lens array can be used to effect a radiation concentration which contributes further to the realization of a sharp shutter edge.

In accordance with at least one embodiment, the headlight device comprises an optical element, which projects the mixed-colored radiation coming from the conversion element onto the roadway. In particular, the conversion element is arranged at the focal point of the optical element. The optical element is preferably arranged on the carrier.

In accordance with at least one embodiment, the optical element is a reflector element arranged between the laser light source and the conversion element. By way of example, the reflector element can be embodied in parabolic fashion, wherein a quarter-reflector shell suffices. The reflector element can at least partly span the conversion element, that is to say that the reflector element is disposed downstream of the conversion element proceeding from the carrier at least at a side surface and at a main surface.

In accordance with at least one embodiment, the reflector element has a diaphragm through which the primary radiation passes during operation. Particularly preferably, the deflection unit is arranged between the laser light source and the diaphragm, wherein the deflection unit directs the primary radiation coming from the laser light source to the diaphragm during operation. The diaphragm is advantageously constituted and arranged such that exclusively the conversion element is illuminated with the laser radiation. In particular, the diaphragm can have a diaphragm shutter for setting a diaphragm aperture. Said diaphragm shutter can be closed in the event of disturbances, for example, and thereby prevent an undeflected beam from emerging.

In accordance with at least one embodiment, the deflection unit has at least one micromirror. The micromirror is advantageously pivotable about two axes. Furthermore, the deflection unit can have a control device provided for driving the micromirror in such a way that the latter adopts a desired spatial position and orientation. In particular, the control device can be designed to direct the primary radiation emitted by the laser light source over the conversion element row by row or column by column by means of the micromirror.

BRIEF DESCRIPTION OF THE DRAWINGS

Further advantages, advantageous embodiments and developments will become apparent from the exemplary embodiments described below in association with the figures.

In the figures.

DETAILED DESCRIPTION OF ILLUSTRATIVE EMBODIMENTS

Figure 1:
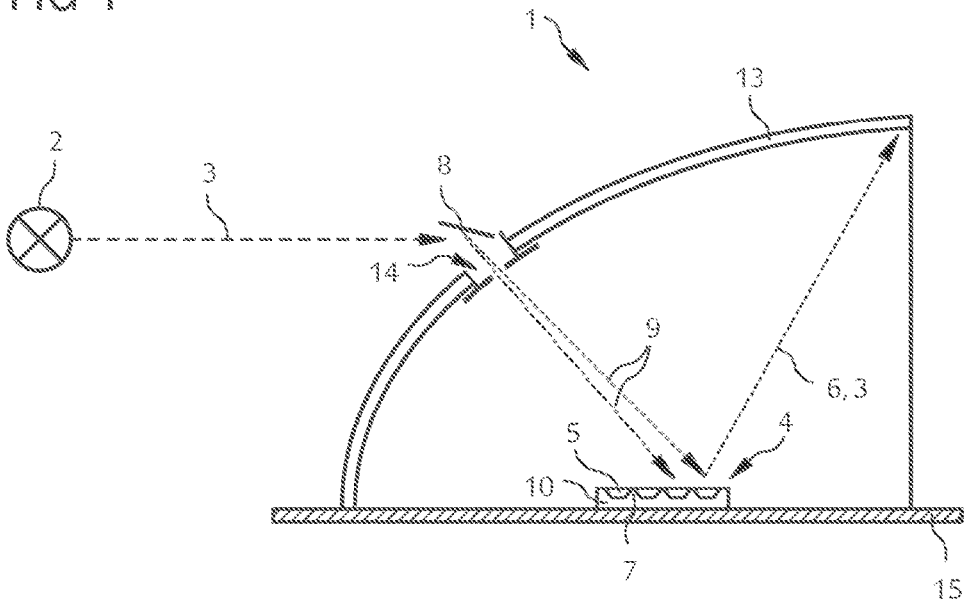
FIG. 1 shows a schematic cross-sectional view of a headlight device in accordance with one exemplary embodiment.

FIG. 1 shows one exemplary embodiment of a headlight device 1. The headlight device 1 comprises a laser light source 2, which emits collimated primary radiation 3. By way of example, the laser light source 2 can comprise at least one laser diode chip, wherein the laser light source 2 is designed to generate a radiation power of 3 watts during operation.

The wavelength of the primary radiation 3 is preferably in the blue visible range. The primary radiation 3 can be unconverted and have a wavelength of between 440 nm and 460 nm. Alternatively, the primary radiation 3 can already be converted, wherein a converter is excited with radiation having a wavelength of 405 nm, which converter re-emits in the visible blue range.

Furthermore, the headlight device 1 comprises a conversion element 4 having a plurality of conversion regions 5 and separating webs 7 that separate the conversion regions 5 from one another. The conversion regions 5 are provided for at least partly converting the collimated primary radiation 3 into secondary radiation 6 and form luminous regions (not illustrated) during operation. The separating webs 7 are nontransmissive to the primary radiation 3 and secondary radiation 6. Advantageously, optical crosstalk between the conversion regions 5 can be reduced or even prevented by means of the separating webs 7. As a result, a sharp shutter edge can be obtained by means of the headlight device 1.

Furthermore, the headlight device 1 comprises a deflection unit 8 having in particular at least one micromirror. Furthermore, the deflection unit 8 can have a control device (not illustrated) provided for driving the micromirror in such a way that the latter adopts a desired spatial position and orientation. In particular, the control device is designed to direct the primary radiation 3 emitted by the laser light source 2 onto the conversion element 4 by means of the micromirror and to guide said radiation as a scanning beam 9 over partial regions of the conversion element 4, which in particular consist of an individual conversion region 5.

Preferably, the conversion regions 5 are arranged in matrix-like fashion along rows and columns in a main body 10 of the conversion element 4.

During operation, with the aid of the deflection unit 8, the scanning beam 9 is directed over the rows and columns of the conversion element 4 and interrupted, if appropriate, in such a way that a pattern arises, which can be designated as pixel light or matrix beam. The pattern is composed of the luminous regions that arise as a result of the excitation of the corresponding conversion regions 5. The radiation of said luminous regions is in particular a mixed-colored radiation composed of the primary radiation 3 and secondary radiation 6. In particular, the luminous regions appear white.

The headlight device 1 additionally comprises an optical element 13 arranged between the laser light source 2 and the conversion element 4. The optical element 13 is preferably a reflector element that reflects the mixed-colored radiation coming from the conversion regions 5 and projects the luminous regions onto a roadway. In particular, the conversion element 4 is arranged at a focal point of the optical element 13. The optical element 13 is a quarter-reflector shell embodied in parabolic fashion.

The optical element 13 has a diaphragm 14, through which the primary radiation 3 coming from the laser light source 2 passes during operation before it impinges on the conversion element 4. The deflection unit 8 deflects the primary radiation 3 in the direction of the diaphragm 14. The diaphragm 14 advantageously has a diaphragm shutter that can be used to set the size and position of the diaphragm aperture. In particular, the diaphragm 14 can be closed in the event of disturbance, such that no laser radiation passes to an observer, as a result of which eye safety is ensured.

The headlight device 1 furthermore comprises a carrier 15, on which the conversion element 4 is arranged. In particular, the carrier 15 is embodied as a heat sink, as already described further above. The optical element 13 is also arranged on the carrier 15 and partly spans the conversion element 4 proceeding from the carrier 15.

In the case of the exemplary embodiment illustrated, the mixed-colored radiation is generated in reflection. That is to say that the mixed-colored radiation is not emitted in the direction of incidence of the primary radiation 3, but rather in a different direction. Alternatively, the mixed-colored radiation can be generated in transmission. In this case, the mixed-colored radiation is emitted in the direction of incidence of the primary radiation 3.

Figure 2:
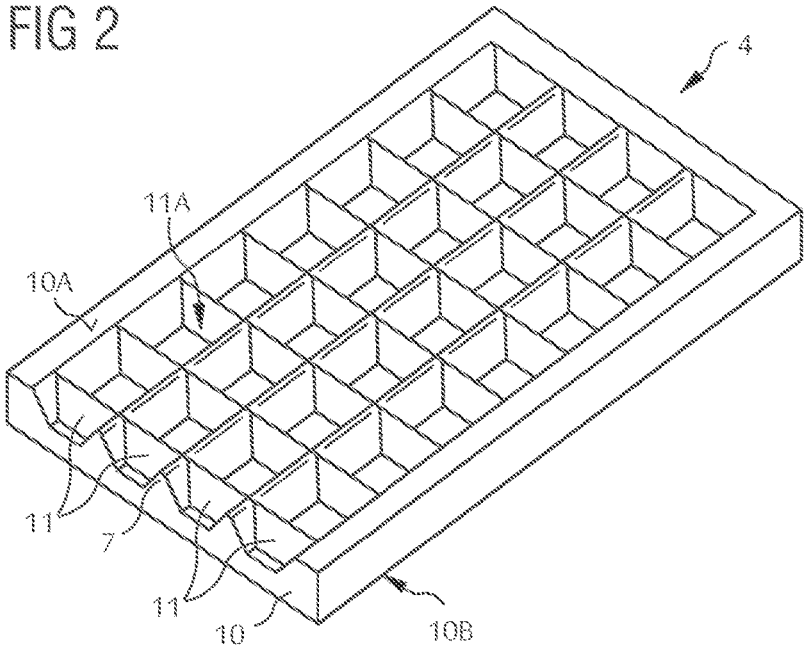
FIG. 2 shows a schematic perspective view of a main body of a conversion element in accordance with one exemplary embodiment.

FIG. 2 illustrates in perspective view one exemplary embodiment of a main body 10 such as is used, for example, in a conversion element 4 of the headlight device 1 shown in FIG. 1. The main body 10 is provided with depressions 11 arranged in matrix-like fashion. The depressions 11 interrupt a main surface 10A of the main body 10. They extend from the main surface 10A in the direction of a rear side 10B of the main body 10, but do not interrupt the rear side 10B of the main body 10. The main body 10 further comprises separating webs 7 that separate the depressions 11 from one another.

In the case of the exemplary embodiment illustrated, the main body 10 consists of Si. The depressions 11 are etched into the main body 10. In the case of Si, the depressions 11 can be produced by an etching process along the {111} crystal planes, wherein sidewalls 11A of the etched depressions 11 run at an angle of 54.7° with respect to the main surface 10A. The depressions 11 have in particular in each case four sidewalls 11A which are inclined at an angle of 54.7° relative to the main surface 10A. The depressions 11 have the shape of an inverted truncated pyramid and taper proceeding from the main surface 10A. They have a cross-sectional area that becomes smaller and smaller proceeding from the main surface 10A. As a result, the depressions 11 advantageously have a beam shaping effect.

The cross-sectional areas of the depressions 11 have in particular a side length of between 200 μm and 1000 μm at the main surface 10A. The depth is preferably between 20 μm and 500 μm. The separating webs 7 arranged between the depressions 11 can have a width of between 0 μm and 200 μm.

The sidewalls 11A are embodied in reflective fashion, wherein, for example, a reflective coating formed from a metal or a metal compound or a diffusely reflective reflection layer is arranged on the main body 10.

Furthermore, the separating webs 7 are advantageously embodied in absorbent fashion at the main surface 10A, which can be realized, for example, by virtue of a roughening of the main body 10 or by virtue of an absorbent coating.

Figure 3A:
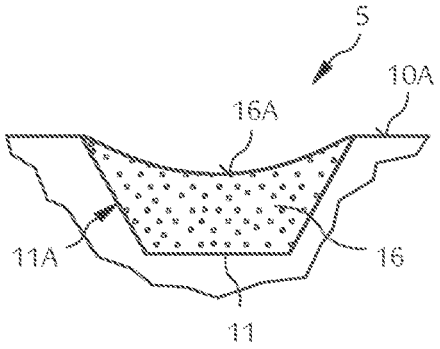
FIGS. 3A and 3B show a schematic cross-sectional view of a conversion region in accordance with different exemplary embodiments.
Figure 3B:
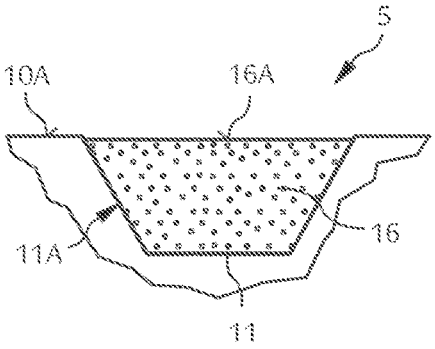

As is shown in FIGS. 3A and 3B, a conversion material 16 is arranged in the depressions 11 of the main body 10 such as is illustrated in FIG. 2. The conversion material 16 contains phosphors that can be embedded into a matrix material. Suitable phosphors have already been described further above.

The conversion material 16 does not project beyond the surface 10A of the main body 10. As is illustrated in FIG. 3A, a surface 16A of the conversion material 16 can be embodied in concave fashion. As is illustrated in FIG. 3B, the surface 16A can alternatively be embodied in planar fashion and terminate flush with the main surface 10A of the main body 10. The conversion regions 5 correspondingly have a concave or planar surface 16A.

Figure 4:
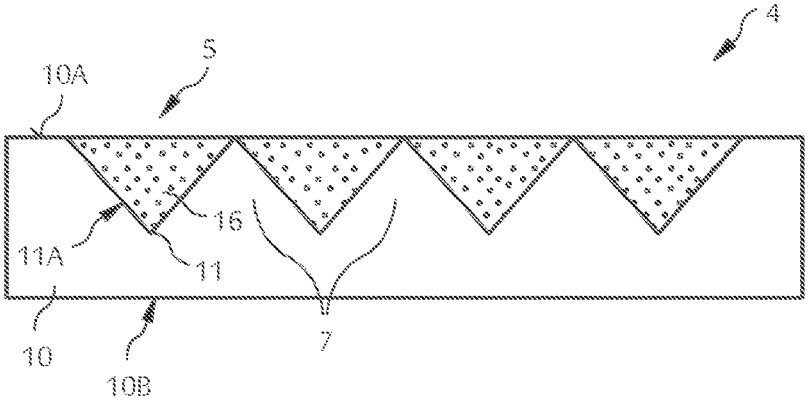
FIG. 4 shows a schematic cross-sectional view of a conversion element in accordance with one exemplary embodiment.

FIG. 4 illustrates a further exemplary embodiment of a conversion element 4. In this case, the depressions 11 have the shape of an inverted pyramid. The depressions 11 are separated from one another by separating webs 7 that form a line at the main surface 10A. In the mathematical sense, the separating webs 7 thus have a width equal to zero at the main surface 10A. The conversion regions 5 are interrupted by the line-like separating webs 7 at the main surface 10.

The invention is not restricted to the exemplary embodiments by the description on the basis of said exemplary embodiments. Rather, the invention encompasses any novel feature and also any combination of features, which in particular includes any combination of features in the patent claims, even if this feature or this combination itself is not explicitly specified in the patent claims or exemplary embodiments.

The invention claimed is:

1. A headlight device comprising:

a laser light source configured to emit collimated primary radiation;

a conversion element comprising conversion regions configured to at least partly convert the collimated primary radiation into secondary radiation and to form luminous regions during operation, and separating webs which separate the conversion regions from one another, wherein the separating webs are nontransmissive to the collimated primary radiation and secondary radiation; and a deflection unit configured to direct the collimated primary radiation onto the conversion element and to guide the collimated primary radiation as a scanning beam over partial regions of the conversion element.

2. The headlight device according to claim 1, wherein a partial region consists of a single conversion region.

3. The headlight device according to claim 1, wherein the conversion element comprises a main body comprising depressions which interrupt a main surface of the main body and the separating webs which separate the depressions from one another; and a conversion material arranged in the depressions, wherein the conversion regions are formed by the depressions and the conversion material and wherein the conversion regions are separated from one another by the separating webs of the main body.

4. The headlight device according to claim 3, wherein at least one sidewall of the depressions is embodied as a reflective sidewall.

5. The headlight device according to claim 4, wherein the reflective sidewall is formed by a reflection layer arranged on the main body.

6. The headlight device according to claim 4, wherein the at least one sidewall runs obliquely with respect to the main surface of the main body, and wherein the depressions taper from the main surface.

7. The headlight device according to claim 3, wherein the main body comprises a semiconductor material or a metal.

8. The headlight device according to claim 7, wherein the main body comprises Si, Ge, GaAs or Al.

9. The headlight device according claim 3, wherein the conversion material does not project beyond the main surface of the main body.

10. The headlight device according to claim 9, wherein the conversion material terminates flush with the main surface of the main body or has a concave surface.

11. The headlight device according to claim 1, further comprising an optical element, wherein the conversion element is arranged at a focal point of the optical element.

12. The headlight device according to claim 11, wherein the optical element is a reflector element which is arranged between the laser light source and the conversion element and has a diaphragm, through which the collimated primary radiation passes during operation.

13. The headlight device according to claim 12, wherein the deflection unit is arranged between the laser light source and the diaphragm and directs the collimated primary radiation coming from the laser light source to the diaphragm during operation.

14. The headlight device according to claim 1, wherein the deflection unit has at least one micromirror.

15. The headlight device according to claim 1, wherein the headlight device is configured to emit pixel light, and wherein each pixel is formed by a luminous region.

16. A headlight device comprising:

a laser light source configured to emit collimated primary radiation;

a conversion element comprising a main body, conversion regions configured to at least partly convert the collimated primary radiation into secondary radiation and to form luminous regions during operation, and separating webs which separate the conversion regions from one another and are nontransmissive to the collimated primary radiation and the secondary radiation; and a deflection unit configured to direct the collimated primary radiation onto the conversion element and to guide the collimated primary radiation as a scanning beam over partial regions of the conversion element, and wherein the main body consists of a semiconductor material or a metal.

17. The headlight device according to claim 16, wherein the headlight device is configured to emit pixel light, and wherein each pixel is formed by a luminous region.

18. A headlight device comprising:

a laser light source configured to emit collimated primary radiation;

a conversion element comprising a main body and a conversion material, wherein the main body comprises depressions interrupting a main surface of the main body and separating webs which separate the depressions from one another, wherein the conversion material is arranged in the depressions, and conversion regions are formed by the depressions provided with the conversion material, wherein the conversion regions are configured to at least partly convert the collimated primary radiation into secondary radiation and to form luminous regions during operation, and wherein the separating webs which separate the conversion regions from one another are nontransmissive to the collimated primary radiation and secondary radiation and comprise a roughening of the main body at the main surface; and a deflection unit configured to direct the collimated primary radiation onto the conversion element and to guide the collimated primary radiation as a scanning beam over partial regions of the conversion element.

19. The headlight device according to claim 18, wherein the headlight device is configured to emit pixel light, and wherein each pixel is formed by a luminous region.

* * * * *